US006194122B1

(12) United States Patent
Ichikawa et al.

(10) Patent No.: US 6,194,122 B1
(45) Date of Patent: Feb. 27, 2001

(54) DIRECTLY IMAGEABLE WATERLESS PLANOGRAPHIC PRINTING PLATE

(75) Inventors: Michihiko Ichikawa, Shiga; Koichi Fujimaru, Niigata; Norimasa Ikeda, Shiga; Ken Kawamura, Shiga; Kazuki Goto, Shiga, all of (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 09/136,942

(22) Filed: Aug. 20, 1998

(30) Foreign Application Priority Data

| | | |
|---|---|---|
| Aug. 20, 1997 | (JP) | 9-223780 |
| Nov. 7, 1997 | (JP) | 9-305673 |
| Feb. 18, 1998 | (JP) | 10-036191 |

(51) Int. Cl.[7] ..... G03C 1/76
(52) U.S. Cl. ..... 430/272.1; 430/281.1
(58) Field of Search ..... 430/270.1, 272.1, 430/280.1, 281.1, 303, 273.1

(56) References Cited

U.S. PATENT DOCUMENTS

| | | | | |
|---|---|---|---|---|
| 4,032,691 | | 6/1977 | Kido et al. | 428/304 |
| 4,755,445 | * | 7/1988 | Hasegawa | 430/138 |
| 4,959,296 | * | 9/1990 | Yoshida et al. | 430/302 |
| 5,089,370 | * | 2/1992 | Tamagawa et al. | 430/138 |
| 5,330,876 | | 7/1994 | Kaszczuk et al. | 430/269 |
| 5,466,557 | * | 11/1995 | Haley et al. | 430/278 |
| 5,849,464 | * | 12/1998 | Yokoya et al. | 430/303 |
| 5,871,883 | * | 2/1999 | Hirano et al. | 430/272.1 |

FOREIGN PATENT DOCUMENTS

| | | | |
|---|---|---|---|
| 0 706 899 A1 | | 4/1996 | (EP) . |
| 780 239 A2 | * | 6/1997 | (EP) . |
| 0 794 069 A2 | | 9/1997 | (EP) . |
| WO 94/01280 | | 1/1994 | (WO) . |

* cited by examiner

*Primary Examiner*—Janet Baxter
*Assistant Examiner*—Barbara Gilmore
(74) *Attorney, Agent, or Firm*—Morrison & Foerster LLP

(57) ABSTRACT

A directly imageable waterless planographic printing plate precursor is a laminate of, in turn, at least a heat sensitive layer and a silicon rubber layer on a substrate. The heat sensitive layer includes (A) a light-to-heat converting material and (B) a compound which contains N—N bonds.

11 Claims, No Drawings

DIRECTLY IMAGEABLE WATERLESS PLANOGRAPHIC PRINTING PLATE

TECHNICAL FIELD

The present invention relates to a waterless planographic printing plate raw plate which makes possible printing without the use of dampening water and, in particular, it relates to a directly imageable waterless planographic printing plate precursor (raw plate) which enables the plate making process to be carried out directly with irradiation from a laser beam, hereinafter called "laser light".

PRIOR TECHNIQUES

Direct plate making, that is to say, directly producing an offset printing plate from an original without using a plate making film is beginning to become popular not only in short run printing fields but also more generally in the offset printing and gravure printing fields, on account of its special features such as its simplicity and lack of requirement for skill, its speediness in that the printing plate is obtained in a short time, and the possibility of selection from diverse systems according to quality and cost.

In particular, very recently, as a result of rapid advances in output systems such as prepress systems, image setters and laser printers, etc, new types of various planographic printing materials have been developed.

Classifying these planographic printing plates by the plate making method employed, such methods include the method of irradiating with laser light, the method of inscribing with a thermal head, the method of locally applying voltage with a pin electrode, and the method of forming an ink repellent layer or ink receptive layer with an ink jet. Of these, the method employing laser light is more outstanding than the other systems in terms of resolution and the speed of the plate making process, and there are many varieties thereof.

There are two types of planographic printing plate employing laser light, the photon mode type which depends on photo-reaction and the heat mode type in which light-to-heat conversion takes place and a thermal reaction is brought about. With the heat mode type there is the advantage that handling is possible in a light room and, furthermore, due to rapid advances in the output of the semiconductor lasers which serve as the light source, recently a fresh look has been taken at the usefulness thereof.

For example, in U.S. Pat. No. 5,379,698 and U.S. Pat. No. 5,632,204, there are described directly imageable waterless planographic printing plates which employ a thin metal film as a heat sensitive layer, and the heat sensitive layer is melted away by laser light irradiation, but there is the problem that the laser light passes through the thin metal film itself, so that the printing plate sensitivity is poor. Hence, in order to raise the laser light absorption factor, a reflection layer must be provided, which further increases the number of application stages and is costly. Moreover, in order to form a thin metal layer, there needs to be used a dry process technique in a vacuum such as the PVD (physical vapour deposition) method or CVD (chemical vapour deposition) method, which results in further expense.

Again, in U.S. Pat. No. 5,339,737, U.S. Pat. No. 5,353,705 and U.S. Pat. No. 5,551,341, there are described directly imageable waterless planographic printing plate precursor which use laser light as the light source.

The heat sensitive layer in these printing plate precursors uses, for example, carbon black as a laser light absorbing compound, and employs nitrocellulose as a thermally-decomposing compound, on the surface of which there is applied a silicone layer. The carbon black in the heat sensitive layer absorbs the laser light, converting it into heat energy and the heat sensitive layer is broken down by this heat. Moreover, finally, this region is eliminated by developing, as a result of which the silicone rubber layer, which does not accept ink, separates away at the same time, thereby forming the image regions which accept ink.

The nitrocellulose employed as the thermally-decomposing substance is an explosive material, and while it is therefore excellent in terms of plate material sensitivity and development properties, care is needed in its handling. Furthermore, since it is an autoxidizing substance, due to the combustion accompanying the laser light irradiation, harmful nitrogen oxide (NOx) is generated, which is undesirable from the point of view of environmental hygiene. Moreover, due to the magnitude of this combustibility, breakdown tends to extend beyond the laser-irradiated region of the heat sensitive layer, so that the boundary between the image and non-image areas is not distinct and there is the problem that the form of the halftone dots following development is impaired.

Again, when the heat sensitive layer is melted away or broken down, the grooves formed by laser irradiation into which ink is to be accepted, hereinafter called "image ditch cells" are deepened, so that the ink mileage is impaired and the printed matter has a feeling of coarseness. Furthermore, with offset printing, either the oven length is extended to evaporate off the ink solvent or it is necessary to drop the printing speed. Hence, if the image ditch cells are deep, this has numerous disadvantages in the printing process. On the other hand, if the heat sensitive layer remains behind in the image areas, then the image ditch cells become shallower, so the ink acceptability and ink mileage are improved and high quality printed materials are obtained. However, in order for the heat sensitive layer to remain behind, it has been necessary hitherto to suppress the heat induced breakdown of the heat sensitive layer, with the result that development of the silicon rubber layer has tended to be impossible, and it has been difficult to obtain a stable high sensitivity plate material.

In JP-A-09-319074, there is described a directly imageable waterless planographic printing plate precursor in which the heat sensitive layer contains a sulphonylhydrazide derivative, which is a foaming agent. With this type of plate material where the silicon rubber layer is separated by foaming of the heat sensitive layer, there is the disadvantage that the heat sensitive layer is embrittled and it is difficult not to remove also the residual heat sensitive layer.

The present invention seeks to overcome these problems of the prior art by providing a directly imageable waterless planographic printing plate precursor of high sensitivity where the heat sensitive layer is removed without employing nitrocellulose in the heat sensitive layer. Furthermore, the invention seeks to provide a residual heat sensitive layer type directly imageable waterless planographic printing plate precursor, where a stable plate material of high sensitivity is obtained by adjusting the heat sensitive layer composition, the laser light irradiation conditions and/or the developing conditions.

DISCLOSURE OF THE INVENTION

In order to solve the abovementioned problems, the present invention provides a printing element comprising a substrate on which is disposed at least a heat sensitive layer, which heat sensitive layer contains a light-to-heat converting material (A) and a compound containing an N—N group, hereinafter referred to as a "hydrazine compound" (B).

Preferably, the printing element is a directly imageable waterless planographic printing plate precursor formed by laminating, in turn, on a substrate, at least a heat sensitive layer and a silicone rubber layer.

More preferably, it is a directly imageable waterless planographic printing plate precursor where the hydrazine compound contains hydroxyl groups, or where it is an acid hydrazine obtained by reaction with a copolymer of (meth) acrylic acid and (meth)acrylate ester, or where it is an ethylenically unsaturated resin containing carboxylic acid groups having hydrazo bonds within the molecule.

Moreover, the invention also provides a directly imageable waterless planographic printing plate precursor which is characterized in that the laser irradiated regions form the image areas and some heat sensitive layer remains behind in the image areas.

PREFERRED EMBODIMENTS OF THE INVENTION

In this specification, "directly imageable" refers to the fact that the image forming is carried out directly from the recording head onto the printing plate without using a negative or positive film at the time of exposure.

Next, explanation is given of the directly imageable waterless planographic printing plate precursor of the present invention.

Heat Sensitive Layer

The heat sensitive layer is susceptible to laser light and degeneration is brought about. In the present invention only degeneration due to heat is employed and it is necessary to include in the heat sensitive layer a 'light-to-heat converting material (A)' which converts the laser light to heat energy.

There are no particular restrictions on the 'light-to-heat converting material (A)' provided that it is a material which can absorb light and convert it to heat and, as examples, there are black pigments such as carbon black, aniline black and cyanine black, green pigments such as those of the phthalocyanine or naphthalocyanine type, carbon graphite, iron powder, diamine type metal complexes, dithiol type metal complexes, phenolthiol type metal complexes, mercaptophenol type metal complexes, arylaluminium metal salts, inorganic compounds containing water of crystallization (such as copper sulphate), chromium sulphide, silicate compounds, metal oxides such as titanium oxide, vanadium oxide, manganese oxide, iron oxide, cobalt oxide and tungsten oxide, the hydroxides and sulphates of these metals, and metal powders of bismuth, tin, tellurium, iron and aluminium.

Of these, carbon black is preferred from the point of view of its light-to-heat conversion factor, cost and ease of handling.

Furthermore, as well as the aforesaid materials, dyes which absorb infrared or near infrared light are also favourably used as the 'light-to-heat converting material (A)'.

All dyes and pigments which have a maximum absorption wavelength in the range from 400 nm to 1200 nm can be used as such dyes, but the preferred dyes are cyanine type, phthalocyanine type, phthalocyanine metal complex type, naphthalocyanine type, naphthalocyanine metal complex type, dithiol metal complex type, naphthoquinone type, anthraquinone type, indophenol type, indoaniline type, pyrylium type and thiopyrylium type, squarilium type, croconium type, diphenylmethane type, triphenylmethane type, triphenylmethane phthalide type, triallylmethane type, phenothiazine type, phenoxazine type, fluoran type, thiofluoran type, xanthene type, indolylphthalide type, spiropyran type, azaphthalide type, chromenopyrazole type, leucoauramine type, rhodamine lactam type, quinazoline type, diazaxanthene type, bislactone type, fluorenone type, monoazo type, ketone imine type, disazo type, methine type, oxazine type, nigrosine type, bisazo type, bisazostilbene type, bisazooxadiazole type, bisazofluorenone type, bisazohydroxyperinone type, azochromium complex salt type, trisazotriphenylamine type, thioindigo type, perylene type, nitroso type, 1:2 metal complex salt type, intermolecular CT type, quinoline type, quinophthalone type and fulgide type acid dyes, basic dyes, oil-soluble dyes, and triphenylmethane type leuco dyes, cationic dyes, azo type disperse dyes, benzothiopyran type spiropyran, 3,9-dibromoanthoanthrone, indanthrone, phenolphthalein, sulphophthalein, ethyl violet, methyl orange, fluorescein, methyl viologen, methylene blue and dimroth betaine.

Of these, cyanine dyes, azulenium dyes, squarilium dyes, croconium dyes, azo disperse dyes, bisazostilbene dyes, naphthoquinone dyes, anthraquinone dyes, perylene dyes, phthalocyanine dyes, naphthalocyanine metal complex dyes, dithiolnickel complex dyes, indoaniline metal complex dyes, intermolecular CT dyes, benzothiopyran type spiropyran, and nigrosine dyes or other black dyes, which are dyes employed for electronics or for recording, and have a maximum absorption wavelength in the range from 700 nm to 900 nm, are preferably used.

Furthermore, from amongst these dyes, those having a large molar absorptibility, formerly referred to as "molar extinction coefficient", (g) are preferably used. Specifically, $\epsilon$ is preferably at least $1\times10^4$ and more preferably at least $1\times10^5$. This is because if $\epsilon$ is below $1\times10^4$, a sensitivity enhancement effect is difficult to realise.

Even using a single such 'light-to-heat converting material (A)', there is a sensitivity enhancement effect, but, by jointly employing two or more types, it is possible to further enhance the sensitivity.

The light-to-heat converting material content is preferably from 2 to 70 wt %, and more preferably from 5 to 60 wt %, in terms of the heat sensitive layer composition as a whole. If there is less than 2 wt %, no sensitivity enhancement effect is to be seen, while with more than 70 wt % the durability of the printing plate tends to be lowered.

Moreover, with dyes of high absorptivity, the laser light is efficiently absorbed on the incident side of the heat sensitive layer and the laser light does not go on to reach the lower region of the heat sensitive layer, so only the upper region of the heat sensitive layer is broken down, with the result that some heat sensitive layer tends to be left. On the other hand, with pigments or with dyes of low absorptivity, the light passes as far as the lower region of the heat sensitive layer and the heat extends over the entire layer, so that the whole heat sensitive layer tends to be broken down. Both can be utilized depending on the requirements.

Some kind of degeneration (such as a reduction in the mechanical strength or an increase in solubility in the developer) is brought about in the heat sensitive layer by the heat produced by conversion from the laser light. Thus, the heat sensitive layer needs to have a structure which is readily degenerated by heat. In the present invention, this is provided by the presence of N—N bonds. The following methods may be adopted for introducing such bonds into the structure of the heat sensitive layer.

The heat sensitive layer contain a 'hydrazine compound (B)'. In compounds with bonds of low bond dissociation energy, the bonds are readily split by heat. The bond dissociation energy of the N—N bonds in a 'hydrazine compound (B)' is extremely low, and such bonds are readily split by heat due to laser irradiation. Nitrogen has may be generated by the thermal decomposition reaction, and a structure which has been crosslinked by N—N bonds may undergo uncrosslinking by the release of $N_2$. In other words, by including a 'hydrazine compound (B)' in the heat sensitive layer, decomposition of the heat sensitive layer occurs with low energy laser light, and the mechanical strength of the heat sensitive layer is weakened in the irradiated regions.

Reference to 'hydrazine compound (B)' in the present invention means a compound having an N—N bond. Specific examples of the 'hydrazine compound (B)' are as follows.

(1) Hydrazine and alkyl(aryl)hydrazines

Hydrazine per se and its hydrate, chloride or sulphate, hydrazobenzene, mono- or di-substituted alkylhydrazines which are substituted by alkyl groups such as a methyl group or ethyl group, and mono- or di-substituted arylhydrazines which are substituted by a phenyl group, p-nitrophenyl group or 2,4-dinitrophenyl group.

(2) Hydroxyalkyl(aryl)hydrazines

Those obtained by an addition reaction between a hydrazine from (1) above and an epoxy compound, or obtained by a substitution reaction with a haloalcohol or halophenol. If there is used as the epoxy compound, a compound which also has an ethylenic double bond such as glycidyl (meth) acrylate or allyl glycidyl ether, it is possible to introduce not just a hydroxyl group but also an ethylenic double bond into the hydrazine.

(3) Hydrazones, azines

These are obtained by a condensation reaction between a hydrazine and/or an aforesaid alkyl(aryl)hydrazine and a carbonyl compound. As examples of the carbonyl compound, there are aldehydes such as formaldehyde and glyoxal, and ketones such as acetone, methyl ethyl ketone, methyl isobutyl ketone and acetyl acetone.

(4) Hydrazides

As examples of the acid hydrazides obtained by the reaction between a carboxylic acid (or derivative thereof) and a hydrazine by known methods, there are acrylic acid hydrazide, methacrylic acid hydrazide, propionic acid hydrazide, adipic, acid dihydrazide, maleic acid hydrazide, maleic acid dihydrazide, isophthalic acid dihydrazide, terephthalic acid dihydrazide, acetone dicarboxylic acid dihydrazide, semicarbazide and semicarbazone. Other examples are thiohydrazide, sulphonylhydrazide, carbazate, thiosemicarbazide, carbo-hydrazide, thiocarbohydrazide, phosphoric acid hydrazide and thiophosphonyltrihydrazide.

These hydrazine compounds (B) have the properties of an amine and react with compounds which are reactive to amines, such as halides, carboxylic acids, esters, anhydrides, acid halides, phenols, aldehydes, nitriles, epoxy compounds and isobyanate compounds. Due to the strong reactivity originating in a strong base, hydrazine reacts with acid amides, urea, carbonic acid, and ketones, etc. By utilizing such reactions, it is possible to lengthen molecules or add functional groups to the hydrazine derivatives.

By carrying out condensation, addition or graft polymerization between these compounds with such reactivity and the hydrazine compounds (B) in (1) to (4) above, or by bonding a hydrazine compound (B) to a functional group as a 'pendant', comparatively high molecular weight hydrazine compounds (B) are obtained. There will now be explained some types of resins (5) to (9) with N—N bonds which are favourably used from the point of view of sensitivity and shape retentivity as a plate material, etc.

(5) Resins with N—N bonds derived from ethylenically unsaturated carboxylic acids.

These can be obtained, for example, by reacting together an ethylenically unsaturated carboxylic acid such as (meth) acrylic acid (or ester or acid chloride thereof) and a hydrazine compound (B) from (1) to (4) above by a known method (acylation), and then polymerization is carried out, optionally along with one or more compound(s) which can copolymerize therewith, or, conversely, the acylation can also be conducted following the polyermization. Again, these resins can also be obtained by the reaction of a hydrazine compound (B) from (1) to (4) above with an ethylenically unsaturated resin having carboxylic acid groups (which resins are available commercially), especially acrylic resins having carboxyl groups.

In such circumstances, as examples of the ethylenically unsaturated carboxylic acid used, there are monocarboxylic acid monomers such as acrylic acid, methacrylic acid, oleic acid, cinnamic acid, crotonic acid, isocrotonic acid, angelic acid [(Z)-2-methyl-2-butenoic acid], tiglic acid [(E)-2-methyl-2-butenoic acid], elaidic acid and atropic acid, and dicarboxylic acid monomers such as maleic acid, fumaric acid, itaconic acid, muconic acid (2,4-hexadienedioic acid) and 1,4-(2-norbornene)dicarboxylic acid. Again, in the case of copolymerization, there may be jointly employed to or more types of the ethylenically unsaturated carboxylic acid (or derivative thereof), or the copolyermization can be carried out along with ethylene, vinyl acetate, vinyl chloride, vinylidene chloride, styrene, 2-methylstyrene, chlorostyrene, acrylonitrile, vinyltoluene (p-methylstyrene), N-methylol (meth)acryl-amide, N-butoxymethyl (meth) acrylamide, vinylpyridine or N-vinylpyrrolidone. Again, modification may be carried out with, for example, a halogen, for the purposes of conferring flame retardancy. Now, ester and halo groups, etc. will react with hydrazine derivatives, so in order for these to remain as functional groups, it is necessary to carry out the preparation by firstly performing acylation and then the polymerization. These resins can be employed singly or two or more types can be jointly employed.

(6) Phenolic resins containing N—N bonds (a) It is possible to obtain phenolic resins with N—N bonds in the main chain by performing polycondensation of the hydrazine compounds (B) in (1) to (4) above with phenols and aldehydes (or ketones). (b) It is possible to obtain phenolic resins with N—N bonds in side chains by grafting the hydrazine compounds (B) to the phenolic hydroxyl groups in the compounds produced by the polycondensation of phenols and aldehydes (or ketones), or (c) by grafting the hydrazine compounds (B) to phenolic resins in which the hydroxyl groups have been variously modified, for example, using an epoxy, or to phenolic resins having carboxyl groups or halo groups as functional groups.

As the phenols, known compounds maybe employed and there can be used monofunctional phenols such as phenol per se, o-cresol, m-cresol, p-cresol, 3,5-xylenol, carvacrol and thymol, difunctional phenols such as catechol, resorcinol and hydroquinone, or trifunctional phenols such as pyrogallol or phloroglucine. These phenols can be employed singly or two or more types can be jointly used.

As the aldehydes, formaldehyde, benzaldehyde, acetaldehyde, crotoaldehyde or furfural, may, for example, be used. Again, these can be employed singly or two or more types can be jointly used. Moreover, as ketones, acetone or methyl ethyl ketone, may, for example, be used.

Examples of the phenolic resin are phenol/formaldehyde resin, m-cresol/formaldehyde resin, m-, o- mixed cresol/formaldehyde resin, resorcinol/benzaldehyde resin, pyrogallol/acetone resin, rosin-modified phenolic resin, epoxy-modified phenolic resin, aniline-modified phenolic resin, melamine-modified phenolic resin and lignin-modified phenolic resin.

(7) Polyamide resins with N—N bonds

It is possible to obtain polyamide resins with N—N bonds in the main chain by using a hydrazine compound (B) from (1) to (4) above as some or all of the amine, in the production of a polyamide by the polycondensation of polyfunctional amine and polyfunctional carboxylic acid, or by reaction of a hydrazine compound (B) with a compound having each of a carboxylic acid group and an amino group and capable additionally of intermolecular self-polycondensation, whereby some of the carboxylic acid groups react with the hydrazine compound and others take part in the self-polycondensation reaction.

(8) Polyester resin with N—N bonds

A polyester with N—N bonds in the main chain is obtained by using a hydroxyalkylhydrazine from (2) above as part or all of the alcohol component in a polyester resin obtained by the polycondensation of polyfunctional alcohol and polyfunctional carboxylic acid, or by reaction of a hydrazine compound (B) with a hydroxy-carboxylic acid compound additionally capable of intermolecular self-polycondensation, so that both reactions take place.

(9) Other resins

As well as (5) to (8), it is also possible to employ resins such as polyurethane resins, polyethylene resins and ethylene copolymers, rosin derivatives such as rosin-modified maleic acid resin and hydrogenated rosin, cellulose resins, ionomer resin and petroleum resins, or elastomers such as diene copolymers, natural rubber, styrene butadiene rubber, isoprene rubber and chloroprene rubber, ester gums, terpene resins, cyclopentadiene resins and aromatic hydrocarbon resins, into which N—N bonding has been incorporated.

Resins and polymers with N—N bonds in side chains are readily obtained by the reaction of a hydrazine compound (B) with a polymer which possesses carboxyl groups or halo groups as functional groups. The method using carboxyl groups has already been explained in detail in the above section (5) on resins with N—N bonds derived from the ethylenically unsaturated carboxylic acids. Now, in the present invention, reference to a compound containing a carboxyl group includes not only carboxylic acids but also, more broadly, carboxylic acid derivatives such as the esters and acid chlorides thereof. In the method using a halo group, by performing a reaction between, for example, an ethylene-vinyl chloride copolymer and a hydrazine derivative, a hydrazino-polyethylene is obtained.

The resins with N—N bonds described in (5) to (9) above preferably have two or more N—N bonds per molecule. Where there are less than two N—N bonds, the sensitivity of the printing plate precursor is lowered. Furthermore, in terms of molecular weight, from 100 to 500,000 is preferred, with from 400 to 150,000 being further preferred.

The amount of compound with N—N bonds in the heat sensitive layer is preferably from 10 to 95 wt %, and more preferably from 20 to 80 wt %, in terms of the heat sensitive layer composition as a whole.

A resin with N—N bonds derived from an ethylenically unsaturated carboxylic acid as described in section (5) above is a particularly preferred form of the hydrazine compound (B) in the present invention. The requirement of the present invention is satisfied by incorporating a compound (5) just as it is, into the heat sensitive layer. However, instead of adopting this method, there may also be incorporated a reactive composition such that, at the time of the preparation of the printing element (i.e. at the time of the formation of the heat sensitive layer), a resin derived from an ethylenically unsaturated carboxylic acid as described in section (5) above is produced by the heat of drying thereof or by irradiation of active light over the entire face. Thus, if a hydrazine compound (B) and a 'polymer with carboxyl groups (D)' are incorporated in the composition for forming the heat sensitive layer, and the two then made to react together by the heat of drying at the time of the film formation, there is formed, as a result, a resin with N—N bonds derived from an ethylenically unsaturated carboxylic acid as described in section (5) above within the heat sensitive layer. Alternatively, instead of a polymer with carboxyl groups (D), there may be included in the composition a 'monomer with a carboxyl group and ethylenic double bond (E)'. In such circumstances, by the heat of drying, reaction takes place between the hydrazine compound (B) and the carboxyl group in the 'monomer with a carboxyl group and ethylenic double bond (E)', to produce an acid hydrazide monomer and, by irradiating active light over the entire face, the monomer is polymerized and there is formed the resin with N—N bonds derived from an ethylenically unsaturated carboxylic acid as described in section (5) above. A known photo-radical generator may also be included at this time. The polymerization need not take place by light irradiation, but may again be carried out by the heat of drying. In such a case, it is necessary to include a thermo-radical generator, examples being peroxides such as acetyl peroxide, cumyl peroxide, tert-butyl peroxide, benzoyl peroxide, lauroyl peroxide, potassium persulphate, diisopropyl peroxydicarbonate, tetralin (tetrahydronaphthalene) hydroperoxide, tert-butyl hydroperoxide, tert-butyl peracetate and tert-butyl perbenzoate, azo compounds such as 2,2'-azobispropane, 1,1'-azo(methylethyl)diacetate, 2,2'-azobisisobutyramide and 2,2'-azobisisobutyramide and 2,2'-azobisisobutyronitrile (AIBN) and benzenesulphonylazide. In such circumstances, at the point of preparation of the composition, (B) and (D,E) may already have been reacted or, conversely, at the time of the film formation unreacted (B) and (D,E) may in part remain.

The heat sensitive layer is preferably crosslinked by means of a 'crosslinking agent (C)', and as the crosslinking agent (C) there may be used any of those described in the Handbook of Crosslinking Agents {Kakyozai Handobukku} S. Yamashita and T. Kaneko, published by Taiseisha Shuppan, (1981). Suitable selection of a crosslinking agent will be made according to the material undergoing crosslinking. In the present invention, isocyanate, epoxy and aldehyde type crosslinking gents are favourably used. Furthermore, it is desirable to include hydroxyl groups in the heat sensitive layer in order to obtain good adhesion between the silicon rubber layer and the heat sensitive layer, so the use of epoxy crosslinking agents is especially preferred.

These crosslinking agents may also react with the compound containing N—N bonds and, in the case where an undermentioned 'binder (F)' is included in the heat sensitive layer, there may also be reaction with the binder (F), or reaction with both. From 0 to 30 wt % of crosslinking agent may be used in the heat sensitive layer.

In the case of the aforesaid crosslinking, the reaction is mostly promoted by means of heat, but the crosslinking reaction may also be promoted by irradiation of, for example, UV light, following application and drying of the heat sensitive layer and/or after providing the silicon rubber layer. As examples of the method for carrying out crosslinking by light irradiation, there is, for example, the method of polymerizing unreacted unsaturated bonds and the method of using a photo acid generator (e.g. epoxy ring-opening polymerization).

In the case of the photopolymerization of unsaturated bonds, it is necessary to add a photoinitiator. As radical generators, there can be used acetophenone type compounds such as diethoxyacetophenone, benzyldimethyl ketal and 1-hydroxycyclohexyl phenyl ketone, benzoin compounds such as benzoin per se, benzoin ethyl ether, benzoin isopropyl ether and benzoin isobutyl ether, benzophenone compounds such as benzophenone per se, methyl o-benzoylbenzoate and 4-benzoyl-4'-methyl-diphenyl sulphide, thioxanthone compounds such as 2-dichlorothioxanthone, amine compounds such as triethanolamine, triisopropanolamine, ethyl 4-dimethylaminobenzoate, 4,4'-bisdiethylaminobenzophenone and 4,4'-bisdimethylaminobenzophenone (Michler's ketone), benzil, camphorquinone, 2-ethylamtnraquinone and 9,10-phenanthrenequinone.

Hitherto, the heat sensitive layer has been designed to be readily removed along with the silicon rubber layer which lies on top. However, when there is a large percentage residual heat sensitive layer following the developing, the image ditch cells become shallower, so the ink acceptability and the ink mileage are improved, and high quality printed materials are obtained. The percentage residual heat sensitive layer is preferably from 30 to 100 wt %, more preferably from 50 to 100 wt %, and with from 70 to 100 wt % most preferred. If the residual amount of the heat sensitive layer is less than 30 wt %, the image ditch cells are deepened and the ink mileage deteriorates, so this is undesirable in terms of print quality.

There is not point in increasing the thickness of the heat sensitive layer to enhance the percentage residual heat sensitive layer. What is important is the depth of the image ditch cells, so the problem is to decide upon the extent to which the thickness of the heat sensitive layer is to be reduced. This reduction in thickness of the heat sensitive layer is preferably no more than 0.70 $g/m^2$ and more preferably no more than 0.50 $g/m^2$.

The percentage of the thickness of heat sensitive layer remaining will depend greatly on the laser output and the composition of the heat sensitive layer. If a laser of excessive energy is irradiated onto the plate material, then, whatever the composition of heat sensitive layer used, the heat sensitive layer will be broken down. On the other hand, if the laser output is kept down to the lowest energy which can sensitise the heat sensitive layer, then, whatever the composition of the heat sensitive layer, it becomes possible, to a certain extent, to increase the percentage thickness of the residual heat sensitive layer. Where the residual heat sensitive layer is adjusted merely by the laser output, the usable laser output range is restricted, and this is impractical. Hence, in order that the laser output range for leaving residual heat sensitive layer can be broadened, and in order to offer a plate material which is not mechanically harmed by the output value thereof, in the present invention the emphasis is placed on the composition of the heat sensitive layer.

By an appropriate choice of the proportional amount and position of the N—N bonds within the structure of the hydrazine compound (B) [or the reaction product of (B) and (D,E)], it is possible to adjust the plate material sensitivity and/or the change in mechanical strength of the heat sensitive layer. In the case of a resin or polymer with N—N bonds in the main chain, the breakdown due to the laser irradiation extends across the matrix as a whole and the heat sensitive layer in the irradiated regions is readily removed by developing. On the other hand, in the case where the N—N bonds are in the polymer side chains, and there is crosslinking between the silicon rubber layer and the heat sensitive layer by means of these side chains, there is a tendency for heat sensitive layer to remain after the developing. For the purposes of having such residual heat sensitive layer, in the case where the silicon rubber layer is of the condensation type, it is necessary to introduce hydroxyl groups into the side chains containing N—N bonds. When the silicon rubber layer is of the addition type, it is necessary to introduce an ethylenic double bond or hydroxyl group into the side chains containing N—N bonds.

It is recommended that the sensitive layer also contains a 'binder (F)' for enhancing the printing durability and the solvent resistance. The binder (F) is not particularly restricted, providing it can be dissolved in an organic solvent and has a film-forming capacity, but in order to confer flexibility upon the heat sensitive layer from the point of view of the durability of the printing plate it is preferred that the binder be a polymer or copolymer having a glass transition temperature ($T_g$) less than 20° C., and more preferably it is a polymer or copolymer having a glass transition temperature below 0° C.

Examples of binders of $T_g$ below 0° C. are polydienes such as polybutadiene, polyisoprene and chloroprene, polyalkenes such as polymethylene, polyethylene and polypropylene, polymethacrylate esters such as polyhexyl methacrylate, polyoctyl methacrylate and polydecyl methacrylate, polyalkylamides such as poly-N-octylacrylamide and poly-N-dodecylacrylamide, polyvinyl ethers such as polyvinyl methyl ether, polyvinyl ethyl ether, polyvinyl propyl ether and polyvinyl thioether, polyvinyl halides such as polyvinylidene chloride and polyvinylidene fluoride, polystyrenes such as poly-4-hexylstyrene, poly-4-octylstyrene, poly-4-decylstyrene and poly-4-tetradecylstyrene, polyoxides such as polymethylene oxide, polyethylene oxide, polytrimethylene oxide, polypropylene oxide and polyacetaldehyde, polyesters such as polydecamethylene terephthalate, polyhexamethylene isophthalate, polyadipoyloxy-decamethylene, polyoxy-2-butynyleneoxysebacoyl and polydioxyethyleneoxymalonyl, polyurethanes such as polyoxy-2-butenyleneoxycarbonyliminohexamethyleneiminocarbonyl, polyoxytetramethyleneoxycarbonyliminohexamethyleneiminocarbonyl and polyoxy-2,2,3,3,4,4,5,5-octafluoro hexamethyleneoxycarbonyliminohexamethyleneiminocarbonyl, cellulose and cellulose trihexanoate. Further examples are the copolymers of two or more monomers selected from ethylene, butadiene, methacrylate esters, acrylamide, vinyl ethers, vinyl esters, vinyl halides, ethylene oxide and acetal. Polyvinyl alchohol obtained from a polyvinyl ester may also be used.

These binders (F) can be used singly or there can be used a mixture of several. The content thereof is preferably from 0 to 70 wt % and more preferably from 5 to 60 wt % in terms of the heat sensitive layer composition as a whole. If the amount included exceeds 70 wt %, there tends to be adverse effects on the image reproducibility.

Other Constituents

Furthermore, in the present invention it is desirable that the heat sensitive layer includes a compound which contains a silyl group. By incorporating a silyl group-containing compound in the heat sensitive layer, not only is the adhesion between the heat sensitive layer and the underlying substrate or heat insulating layer improved, but also good adhesion to the upper silicone rubber layer is stably realised and high printing durability obtained. Reference here to a silyl group-containing compound means a compound having a group of a structure represented by general formula (1).

$$-SiR_nX_{3-n} \quad (1)$$

(Here, n is zero, 1, 2 or 3, and R represents an alkyl group, alkenyl group, aryl group or a combination of such groups, and these groups may also have functional groups such as halogen atoms, isocyanate groups, epoxy groups, amino groups, hydroxy groups, alkoxy groups, aryloxy groups, (meth)acryloxy groups or mercapto groups, as substituents. X represents a functional group such as a hydrogen atom, hydroxyl group, alkoxy group, acyloxy group, ketoxime group, amide group, aminooxy group, amino group or alkenyloxy group.)

Specific examples of the structure represented by general formula (1) are the alkoxysilyl group, acetoxysilyl group, oximesilyl group,

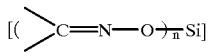

trimethylsiloxy group, triethylsiloxy group and triphenylsiloxy group. Of these, the alkoxysilyl group, acetoxysilyl group and oximesilyl group are preferred.

The silyl group-containing compound used in the present invention preferably also has a functional group such as a hydroxyl group, amino group, unsaturated group, mercapto group or epoxy group, with a hydroxyl group or unsaturated group being particularly preferred.

Such functional groups can be utilized for achieving adhesion between the silicone rubber layer and the heat sensitive layer, for achieving adhesion between the heat sensitive layer and the substrate or thermally insulating layer, or for forming a crosslinked structure within the heat sensitive layer.

As specific examples of reactions which can be utilized for achieving adhesion between the silicone rubber layer and the heat sensitive layer, there are the reaction between hydroxyl groups in the heat sensitive layer and a condensation type silicone rubber crosslinking agent, the reaction between unsaturated groups in the heat sensitive layer and the SiH groups of an addition type silicone rubber, and the reaction between hydroxyl groups in the heat sensitive layer and the SiH groups of an addition type silicone rubber.

As specific examples of reactions which can be utilized for forming a crosslinked structure in the heat sensitive layer, there are the reaction between the hydroxyl groups in the heat sensitive layer and polyisocyanates, epoxy resins, polyamines and amine derivatives, polycarboxylic acids and carboxylic acid derivatives such as carboxylic acid chlorides, or metal chelate compounds, ene.thiol addition by means of a polythiol compound and the unsaturated groups, and thermo or photo radical polymerization of the unsaturated groups.

These silyl group-containing compounds can be used singly or several can be mixed together. The amount thereof, when present, is up to 30% wt, preferably from 1 to 30 wt % and more preferably from 2 to 25 wt % in terms of the heat sensitive layer composition as a whole. If there is more than 30% the sensitivity of the plate material tends to be reduced.

There may also be freely added, in addition to the above constituents, other constituents such as dyes, acids, levelling agents, surfactants, colour developing agents and plasticizers.

The composition for forming the heat sensitive layer may be prepared as a solution by dissolving the above components in a suitable solvent such as dimethyl formamide, methyl ethyl ketone, methyl isobutyl ketone, dioxane, toluene, xylene, ethyl acetate, butyl acetate, isobutyl acetate, isoamyl acetate, methyl propionate, ethylene glycol monomethyl ether, ethylene glycol dimethyl ether, ethylene glycol monoethyl ether, ethylene glycol diethyl ether, acetone, methanol, ethanol, cyclopentanol, cyclohexanol, diacetone alcohol, benzyl alcohol, butyl butyrate or ethyl lactate. By uniformly applying this composition in the form of a solution onto the substrate and hardening by heating for the required time at the required temperature, the heat sensitive layer may be formed.

The film thickness of the heat sensitive layer is preferably from 0.1 $g/m^2$ to 10 $g/m^2$, and more preferably from 0.2 $g/m^2$ to 5 $g/m^2$. If the film thickness is less than 0.1 $g/m^2$, the printing durability tends to be lowered, while if it is a thick film of more than 10 $g/m^2$, this is disadvantageous in terms of cost. Hence, the abovementioned range is particularly preferred.

Silicone Rubber Layer

As the silicone rubber layer employed in the printing plate of the present invention, any conventional silicone composition used for waterless planographic printing plates can be used.

Such a silicone rubber layer may be obtained by lightly crosslinking a linear organopolysiloxane (preferably dimethylpolysiloxane), and a typical silicone rubber layer has repeating units of the kind represented by the following formula (II):

(II)

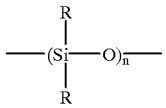

(Here n is an integer of 2 or more; and each R independently is hydroxyl or a group selected from $C_{1-10}$ alkyl, $C_{6-10}$aryl and cyano-$C_{1-10}$ alkyl groups, which group is optionally substituted by hydroxyl. It is preferred that no more than 40% of all the R groups are vinyl, phenyl, halo-vinyl or halo-phenyl, and that at least 60% of the R groups are methyl. Furthermore, optionally, there may be at least one hydroxyl group on the molecular chain, in the form of a chain terminal or pendant group).

In the case of the silicone rubber layer employed on the printing plate precursor of the present invention, it is possible to use a silicone rubber where condensation-type crosslinking of the following kind is carried out (RTV or LTV silicone rubber). There can be used, as this silicone rubber, one in which some of the R groups along the organopolysiloxane chain have been replaced by H but, normally, crosslinking is effected by condensation between terminal groups represented by (III), (IV) and (V).

(III)

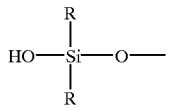

(IV)

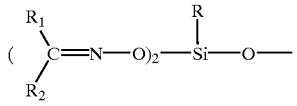

(V)

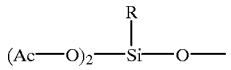

(Here, R is the same as the R groups explained for formula (II) above, $R_1$ and $R_2$ are monovalent lower alkyl groups, and Ac is an acetyl group.)

To the silicone rubber where such condensation type crosslinking is to be carried out, there is added a catalyst such as a tin, zinc, lead, calcium, manganese or other such metal salt of a carboxylic acid, for example dibutyltin laurate, or tin(III) octoate or naphthenate, or alternatively chloroplatinic acid.

Optionally, along with these constituents, there may be added a known adhesion conferring agent such as an alkenyltrialkoxysilane. Furthermore, with the objective of enhancing the rubber strength, there may be freely added known fillers such as silica.

Moreover, in the present invention, besides the aforesaid condensation type silicone rubber it is also possible to use an addition type silicone rubber.

For this addition type silicone rubber, there may be employed as the main agent (a), i.e., no other component is present to a greater amount, an alkenyl group-containing polysiloxane, and, as the crosslinking agent (b), a hydrogensiloxane. Again, where required, in order to enhance the adhesion to the heat sensitive layer, there may also be added (c) an unsaturated group-containing silane of the kind which is an adhesion conferring component in silicone rubber in general.

The alkenyl groups of component (a) may be at the terminals and/or at intermediate positions in the molecular chain, and organic groups other than alkenyl groups which may be present are substituted or unsubstituted alkyl groups or aryl groups. Moreover, component (a) may also contain a minute proportion of hydrogen atoms.

The hydrogen atoms of component (b) may be at the terminals or at intermediate positions in the molecular chain, and the organic groups other than the hydrogen groups may be selected from the same groups as in component (a). From the point of view of ink repellency, it is preferred as a rule that at least 60% of the organic groups in components (a) and (b) are methyl groups. The molecular structure of components (a) and (b) may be straight chain, cyclic or branched, and it is preferred that the molecular weight of at least one or the other exceeds 1000.

Examples of component (a) are α,ω-divinylpolydimethylsiloxanes and (methylvinylsiloxane)/(dimethylsiloxane) copolymers with methyl groups at both terminals, and as examples of component (b), there are polydimethylsiloxanes with hydrogen atoms at both terminals, α,ω-dimethylpolymethylhydrogensiloxanes, (methylhydrogensiloxane)/(dimethylisoxane) copolymers with methyl groups at both terminals, and cyclic polymethylhydrogensiloxanes.

The hydrogensiloxane component (b) not only crosslinks the silicone rubber by crosslinking with the alkenyl groups of component (a), but also reacts with double bonds in the heat sensitive layer to bring about adhesion between the silicone rubber layer and the heat sensitive layer. Hence, it is necessary to include excess of the Si—H component (b) per equivalent of alkenyl groups in components (a), and specifically it is preferred that from 1.05 to 5 equivalents be employed.

As an adhesion-conferring component, there is selected an unsaturated group-containing silane (c) (or composition containing it) which has an unsaturated bond for reacting with the hydrogensiloxane in the addition-type silicone rubber composition and, furthermore, also has a reactive functional group such as an alkoxy group, oxime group, alkylcarbonyloxy group, chloro group or epoxy group, which reacts with the hydroxyl groups or amino groups in the heat sensitive layer. A reactive functional group such as an alkylcarbonyloxy group, is split by hydrolysis and forms an unsaturated group-containing hydroxysilane and there is reaction between the hydroxyl groups thus produced and the hydroxyl groups or amino groups in the heat sensitive layer, bringing about adhesion between the silicone rubber layer and the heat sensitive layer. Since the reaction is rapid, low temperature curing is possible, there is little change with elapse of time and, moreover, the adhesion between the silicone rubber layer and heat-sensitive layer is firm and stable. It is necessary that the unsaturated group in the unsaturated group-containing silane (c) not be eliminated in the presence of moisture, and it is preferred that there not be an oxygen atom or the like interposed between the silicon atom and the unsaturated bond, examples being the vinyl group, allyl group and (meth)acryl group. From the point of view of their reaction rate, the preferred reactive functional groups used are the alkylcarbonyloxy group and the oxime group. As examples of the alkylcarbonyloxy group, there are the acetoxy group, ethylcarboxy group, acryloxy group and methacryloxy group, and as examples of the oxime group there are the dimethylketoxyimino group and methylethylketoxyimino group.

The unsaturated group-containing silane (c) needs to contain in the molecule at least 1 unsaturated functional group and at least 1 reactive functional group, and it is preferred that there be at least 2 reactive functional groups. As other functional groups, there may be, for example, alkyl groups, aryl groups, amino groups or hydrogen groups.

Furthermore, it is especially preferable to add (d) a curing catalyst in order that the silicone rubber crosslinking reaction may proceed efficiently, and also (e) a reaction inhibitor with the objective of controlling the hardening rate.

As the curing catalyst (d), there is used a reaction catalyst for addition-type silicones and practically all Group VIII transition metal complexes can be used. Platinum or platinum compounds are preferably employed since they give the best reaction efficiency and their solubility is good. Amongst these, simple platinum, platinum chloride, chloroplatinic acid, olefin-coordinated platinum, alcohol-modified platinum complexes and methyl-vinylpolysiloxane platinum complexes are more preferably used.

Examples of the reaction inhibitor (e) are vinyl group-containing organopolysiloxanes such as methylvinylcyclotetrasiloxane, acetylene alcohols, siloxane-modified acetylene alcohols, hydroperoxide, acetone, methyl ethyl ketone, methanol, ethanol and propylene glycol monomethyl ether.

The addition reaction occurs and the hardening begins at the point when the three components, namely the main ingredient (a), the crosslinking agent (b) and the hardening catalyst (d) are mixed together, but it is a characteristic that, along with a rise in the reaction temperature, the hardening rate rapidly increases. Thus, with the objective of shortening the hardening time on the heat sensitive layer, it is preferred, from the point of view of the stability of the adhesive strength to the heat sensitive layer, that the composition be hardened by holding it at a high temperature, until hardening is complete, under conditions within a temperature range which do not alter the properties of the substrate or heat sensitive layer.

With regard to the amounts of the individual constituents, per 100 parts by weight of (a), the alkenyl group consisting polysiloxane, there is preferably from 0.5 to 1000 parts by weight, more preferably 1 to 100 parts by weight and still more preferably 1.5 to 50 parts by weight of the hydrogenorganosiloxane (b). If there is less than 0.5 part by weight, the hardening of the silicone rubber tends to be impaired.

In the same way, there is preferably used up to 20 parts by weight, more preferably up to 10 parts by weight and still more preferably up to 5 parts by weight of the unsaturated group-containing silane (c). If there is more than 20 parts by weight the stability of the coating liquid tends to be lowered.

In the same way, there is preferably used from 0.001 to 15 parts by weight, more preferably from 0.001 to 10 parts by weight and still more preferably from 0.01 to 10 parts by weight of the hardening catalyst (d). If there is less than 0.001 part by weight, the silicone rubber shows poor hardening, while if there is more than 15 parts by weight the stability of the coating liquid tends to be lowered.

In the same way, there is preferably used from 0.01 to 25 parts by weight, more preferably from 0.1 to 10 parts by weight and still more preferably from 0.5 to 7 parts by weight of the reaction inhibitor (e). If there is less than 0.01 part by weight, the stability of the solution tends to be reduced while if there is more than 25 parts by weight the hardening of the silicone rubber tends to be impaired.

The film thickness of the silicone rubber layer is preferably from 0.5 to 50 g/m$^2$ and more preferably from 10 g/m$^2$. If the thickness is less than 0.5 g/m$^2$, then the ink repellency of the printing plate tends to be lowered, while if it is greater than 50 g/m$^2$ this is economically disadvantageous.

Substrate

The substrate for the printing plate precursor is a dimensionally stable sheet material. Such dimensionally stable sheet materials include those conventionally employed as printing plate substrates, and these are suitably employed. Such substrates include paper, plastics materials (for example polyethylene, polypropylene and polystyrene), zinc, copper and other such metal sheets, films of plastics material such as cellulose, carboxymethylcellulose, cellulose acetate, polyethylene, polyester, polyamide, polyimide, polystyrene, poly-propylene, polycarbonate or polyvinyl acetate, and also paper or films of plastics material laminated with, or with a vapour deposited coating of, an abovementioned metal. Amongst these substrates, aluminium plates are especially preferred in that they have outstanding dimensional stability and, moreover, are comparatively cheap. Again, polyethylene terephthalate films which are employed as substrates for short-run printing are also favourably used.

heat Insulating Layer

In order to shield the substrate from the heat due to the laser irradiation, it is effective to provide the directly imageable waterless planographic printing plate precursor used in the present invention with a heat insulating layer disposed between the substrate and the heat sensitive layer. There may also be used, typically, the known primer layers hitherto employed for firmly bonding the substrate and heat sensitive layer. The heat insulating layer of the directly imageable waterless planographic printing plate precursor used in the present invention needs to satisfy the following conditions. It will bond together well the substrate and the heat sensitive layer, it will be stable with passage of time, and it will also be resistant to the developer solvent.

The composition for forming the heat insulating layer can be prepared in the form of a solution by dissolving the heat insulating component in an organic solvent such as dimethylformamide, methyl ethyl ketone, methyl isobutyl ketone or dioxane, to form a composition. Then, the heat insulating layer may be formed by uniformly coating the composition onto the substrate and heating for the required time at the required temperature.

The thickness of the heat insulating layer is preferably from 0.5 to 50 g/m$^2$ and more preferably from 1 to 10 g/m$^2$ as a coating layer. If the thickness is less than 0.5 g/m$^2$, there is an inadequate insulating effect in terms of substrate surface defects and chemical influences, while if the thickness is more than 50 g/m$^2$ this is disadvantageous from economic considerations, and hence the above range is preferred.

Cover Film

With the objective of, for example, protecting the silicone rubber layer at the surface of the directly imageable waterless planographic printing plate precursor constructed as explained above, there may be laminated on the surface of the silicone rubber layer a planar or thin protective film which is roughened, for example, by depositing thereon particles of an inorganic material such as silica, or there may be formed a polymer coating which dissolves in the developer solvent.

In particular, in the case of the lamination of a protective film, it is also possible to form the printing plate by the so-called peel developing method in which the laser irradiation is carried out from above the protective film, after which the pattern is formed on the printing plate by peeling off the protective film.

Production Method

Explanation is now provided of the method of producing the waterless planographic printing plate precursor in the present invention. On the substrate, using a normal coater such as a reverse roll coater, air knife coater or Meyer bar coater, or a rotary applicator such as a whirler, there is optionally applied a heat insulating layer composition and this hardened by heating for a few minutes at 100 to 300° C., after which a heat sensitive layer composition coating liquid is applied and hardened by heating for a few minutes at 50 to 180° C., or alternatively photocuring performed, and then a silicone rubber layer composition coating liquid is applied and rubber curing performed by treatment for a few minutes at a temperature in the range 50 to 200° C. Subsequently, where required, a protective film is laminated or a protective layer is formed.

Laser Irradiation

The directly imageable waterless planographic printing plate precursor obtained in this way is subjected to imagewise irradiation with laser light after separating off the protective film or from above the protective film.

Normally laser light is used for the irradiation and, as the light source at this time, various lasers with a wavelength in the range 300 nm to 1500 nm can be employed, such as an Ar ion laser, Kr ion laser, He—Ne laser, He—Cd laser, ruby laser, glass laser, semiconductor laser, YAG laser, titanium sapphire laser, dye laser, nitrogen laser or metal vapour laser.

Of these, the semiconductor laser is preferred since, due to technological advances in recent years, it has been made more compact, and in terms of economics, it is more advantageous than other laser light sources.

The directly imageable waterless planographic printing plate precursor which has undergone laser irradiation by the above method is then subjected, as required, to peel development or to an ordinary solvent development treatment.

Developing Method

As the developers used when preparing a printing plate from a precursor of the present invention, there can be employed those normally proposed for waterless planography. For example, there is preferably used water, or water to which an alcohol, ether, ester or carboxylic acid, has been added, or one or more solvents such as an aliphatic hydrocarbon (eg hexane, heptane, "Isopar E, G, H" (trade names of isoparaffin type hydrocarbons produced by Esso), gasoline or kerosene, aromatic hydrocarbon (Triclene, etc), to which at least one polar solvent such as an alcohol or ether has been added.

Furthermore, to the developer liquid composition there may be freely added known surfactants. Moreover, there can also be added an alkali agent, such as sodium carbonate, monethanolamine, diethanolamine, diglycolamine, monoglycolamine, triethanolamine, sodium silicate, potassium silicate, potassium hydroxide or sodium borate. It is also effective to use an aqueous alkali solution.

Of these, developers based on water are most preferably used from the point of view of disposal. Additionally, development is also possible by spraying the plate face with hot water or steam.

Again, it is also possible to add to such developers known basic dyes, acid dyes or oil-soluble dyes such as Crystal Violet, Victoria Pure Blue or Astrazon Red, to carry out dyeing of the image region at the same time as the development.

The method of development may be either by hand or by means of known developing equipment. In the case of developing by hand, this is carried out, for example, by impregnating a nonwoven material, degreased cotton, a cloth or sponge with the developer and wiping the plate surface. In the case where developing equipment is used, there may be employed the TWL-1160 or TWL-650 developing equipment produced by Toray Industries Inc., or the developing equipment disclosed in, for example, JP-A-04-002265, JP-A-05-002272 and JP-A-05-006000.

Up to now, the above description has related to a waterless planographic printing plate precursor, but the present invention is also applicable to conventional pre-sensitized planographic printing plate precursors needs to be dampened with water. The construction of such pre-sensitized planographic printing plate precursors involves the lamination of a heat sensitive layer on a substrate, and there is no lamination of a silicone rubber layer. The ink repellency is realized by dampening water spread over a hydrophilic surface. Hence, it is necessary that the heat sensitive layer be hydrophobic. The underlayer needs to be hydrophilic. In order to ensure that the heat sensitive layer underlayer has a hydrophilic character, either the substrate is given a hydrophilicity-conferring treatment by a known method, or a hydrophilic layer may be provided between the heat sensitive layer and the substrate.

As the heat sensitive layer in a conventional pre-sensitized planographic printing plate, there can be used a heat sensitive layer as described above in the section on the heat sensitive layer for the waterless planographic printing plate precursor, but in order to be able to completely remove the heat sensitive layer in the laser-irradiated regions with alkali or a developer in which alkali is the chief component, there should also be added a binder having phenolic or alcoholic hydroxyl groups. As examples of such a binder, there are the copolymers of (N-(4-hydroxyphenyl) acrylamide, N-(4-hydroxyphenyl)methacrylamide, hydroxystyrene, hydroxy-phenyl (meth)acrylate, hydroxyethyl (meth)acrylate or vinyl alcohol. Alternatively, there may be employed a polyurethane which can be dissolved in alkali.

EXAMPLES

Embodiments of the present invention are now explained in more detail by means of Examples.

Example 1

A heat insulating layer of film thickness 4 g/m$^2$ was provided by coating a primer liquid of the following composition onto a degreased aluminium sheet of thickness 0.15 mm using a bar coater and drying for 2 minutes at 180° C.

| Heat Insulating Layer Composition (solids component concentration 13 wt %) | |
|---|---|
| (a) polyurethane resin ("Sanprene" LQ-T1331, produced by Sanyo Chemical Industries Ltd.) | 90 parts by weight |
| (b) blocked isocyanate ("Takenate" B830, produced by Takeda Chemical Industries Ltd.) | 35 parts by weight |
| (c) epoxy-phenol-urea resin (SJ9372, produced by the Kansai Paint Co. Ltd.) | 8 parts by weight |
| <Solvent Component> | |
| (d) dimethylformamide | |

Next, on this there was provided a heat sensitive layer of film thickness 1 g/m$^2$ by coating the following heat sensitive layer composition using a bar coater and drying for 3 minutes at 90° C.

| Heat Sensitive Layer Composition (solids component concentration 8.5 wt %) | |
|---|---|
| (a) carbon black dispersed acrylic resin | 30 parts by weight |
| (of which the amount of carbon black | 15 parts by weight) |
| (b) compound A with N—N bonds in side chains | 50 parts by weight |

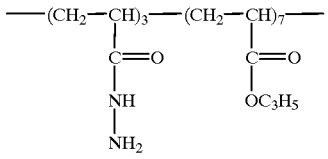

Compound A (MW = 50,000)

| | |
|---|---|
| (c) polyglycerol polyglycidyl ether ("Denacol" EX512, produced by Nagase Chemicals Ltd.) | 5 parts by weight |

-continued

| <Solvent Component> | |
|---|---|
| (e) tetrahydrofuran | 22 parts by weight |
| (f) dimethylformamide | 56 parts by weight |
| (g) methyl isobutyl ketone | 22 parts by weight |

Next, on this was provided a silicone rubber layer of film thickness 2 g/m$^2$ by the coating of a de-oxime type condensed type silicone rubber composition of the following composition using a bar coater and then performing moist heat hardening and drying at a dew point of 30° C. and at a temperature of 125° C.

| Silicone Rubber Layer Composition (solids component concentration 11 wt %) | |
|---|---|
| (a) polydimethylsiloxane (molecular weight about 25,000, terminal hydroxyl groups) | 100 parts by weight |
| (b) vinyltris(methylethylketoxyimino)silane of the formula $[(C_2H_5)(CH_3)C{=}N{-}O]_3Si{-}CH{=}CH_2$ | 10 parts by weight |
| <Solvent Component> | |
| (c) "Isopar-E" (produced by Exxon Chemical Japan Ltd.) | |

On the laminate obtained as described above, there was laminated 8 μm thick "Lumirror" polyester film (produced by Toray Industries, Inc.) using a calender roller, and there was obtained a directly imageable waterless planographic printing plate precursor.

Plate Processing

Subsequently, the "Lumirror" was peeled off from this printing plate precursor and, using a semiconductor laser (OPC-A001-mmm-FC, wavelength 780 nm, produced by the OPTO Power Corporation) mounted on an X-Y table, pulse-exposure time of 10 μs. The irradiation was performed at this time using different laser outputs of 350 mW, 300 mW, 250 mW, 200 mW, 150 mW and 100 mW.

Plate Development

Next, the aforesaid irradiated plate was developed using a TWL-1160 (a waterless planographic printing plate developing machine, produced by Toray Industries, Inc.) at a rate of 80 cm/min. Here, as a pre-treatment liquid, there was employed a liquid with the following composition at a liquid temperature of 40° C.

| | |
|---|---|
| (a) polypropylene glycol (molecular weight 200) | 95 parts by weight |
| (b) water | 5 parts by weight |

Furthermore, water was used as the developing liquid and the liquid temperature was 25° C. As a dye liquid, there was employed a liquid with the following composition and the liquid temperature was 25° C.

| | |
|---|---|
| (a) C.I. Basic Blue 1 dyestuff | 0.2 part by weight |
| (b) butyl carbitol | 5 parts by weight |
| (c) sodium 2-ethylhexylsulphate | 0.3 part by weight |

-continued

| | |
|---|---|
| (d) silicone antifoaming agent | 0.0005 part by weight |
| (e) water | 95 parts by weight |

Evaluation of the condition of the image area/non image area boundary

The evaluation of the plate following development was performed by observing the heat sensitive layer surface state in the image area and the state of the image area/non image area boundary with a 50x Lupe. Where the boundary was sharp and the silicone rubber layer in the image area was free of fringes and separation thereof could be achieved, the evaluation was 0; where the boundary had a saw blade shape and silicone rubber fringes were to be seen, the evaluation was Δ; and where the silicone rubber layer could not be separated, the evaluation was X.

Evaluation of Plate Sensitivity

Next, the sensitivity was investigated by spreading waterless planographic ink (Waterless S, produced by Inctec Inc., red) over the entire plate face using a hand roller.

The plate face was then observed for the respective irradiation conditions, and where the ink was uniformly accepted by the image area, this was denoted by 0; where the ink was accepted non-uniformly on the image area, this was denoted by Δ; and where the ink was not accepted at all on the image area, or the silicone rubber layer could not be separated away, this was denoted by X. Where the silicone rubber layer could be separated and the ink uniformly accepted even under low laser output conditions, this indicated high sensitivity. The plate sensitivity and the results are shown in Table 1. The results for Examples 2 to 26 below and for comparative Examples 1 to 6 are also shown in Tables 1–3.

Evaluation of the percentage heat sensitive layer remaining

Irradiation with high energy laser light tends to accelerate breakdown of the heat sensitive layer. This can be readily appreciated from the fact that, if there is irradiation with high energy laser light, then development becomes possible with many plate materials. Now, from within the range of laser irradiation output values used in normal plate processing, if some heat sensitive layer remains behind in the irradiated area at the high energy end of the output range, then it can be said that heat sensitive layer will remain under most circumstances. Thus, the percentage heat sensitive layer remaining in the irradiated area under the highest energy conditions employed in these examples, namely an output of 350 mW, was measured. In other words, this value denotes the lowest percentage of heat sensitive layer which will remain. The measurement is conducted by a gravimetric method, and calculation can readily be performed from the measured values of the weight-base film thickness of the heat sensitive layer before and after irradiation. That is to say.

percentage heat sensitive layer remaining$=100\times W_1/W_2$ $W_1$: film thickness, by weight, of the heat sensitive layer after laser irradiation $W_2$: film thickness, by weight, of the heat sensitive layer before laser irradiation Comparative Example 1, Example 2

Plates were processed and evaluated in the same way as in Example 1 except that the compound A with N—N bonds in the side chains which comprised (b) in the heat sensitive layer composition of Example 1 was altered either to Compound B which did not contain N—N bonds (Comparative Example 1) or to Compound C which had N—N bonds in the main chain (Example 2).

Compound B

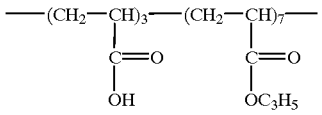

(MW = 50,000)

Compound C

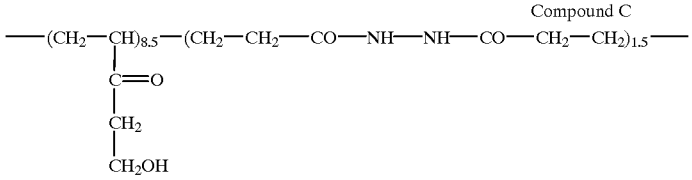

(MW = 20,000)

Comparative Example 2

Preparation of the plate material and evaluation were all carried out in the same way as in Example 1 except that the heat sensitive layer composition was changed to that below.

| Heat Sensitive Layer Composition (solids component concentration 10 wt %) | |
|---|---|
| (a) carbon black | 15 parts by weight |
| (b) nitrocellulose | 36 parts by weight |
| (c) epoxy resin | 25 parts by weight |
| (d) melamine resin | 24 parts by weight |
| <Solvent Component> | |
| (e) dimethylformamide | 11 parts by weight |
| (f) methyl isobutyl ketone | 88 parts by weight |

Comparative Example 3

Preparation of the plate material and evaluation were all carried out in the same way as in Comparative Example 2 except that, in the heat sensitive layer, (b) was changed from a nitrocellulose content of 36 parts by weight to 56 parts by weight, (c) was changed from an epoxy resin content of 25 parts by weight to 15 parts by weight, and (d) was changed from a melamine resin content of 24 parts by weight to 14 parts by weight.

Comparative Example 4

Preparation of the plate material and evaluation were all carried out in the same way as in Comparative Example 2 except that, in the heat sensitive layer, (b) was changed from a nitrocellulose content of 36 parts by weight to 16 parts by weight, (c) was changed from an epoxy resin content of 25 parts by weight to 35 parts by weight, and (d) was changed from a melamine resin content of 24 parts by weight to 34 parts by weight.

Example 3

On the heat insulating layer in Example 1, there was provided a heat sensitive layer of film thickness 1 g/m$^2$ by applying the following heat sensitive layer composition using a bar coater and drying for 3 minutes at 90° C.

| Heat Sensitive Layer Composition (solids component concentration 9 wt %) | |
|---|---|
| (a) carbon black dispersed acrylic resin | 30 parts by weight |
| (of which the carbon black | 15 parts by weight) |
| (b) compound D with N—N bonds in side chains | 50 parts by weight |

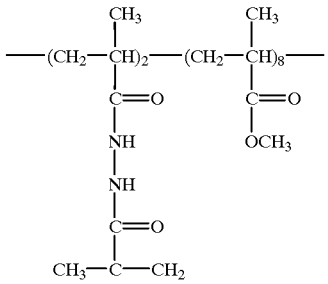

Compound D (MW = 40,000)

| | |
|---|---|
| (c) polyglycerol polyglycidyl ether ("Denacol" EX512, produced by Nagase Chemicals Ltd.) | 10 parts by weight |
| <Solvent Component> | |
| (e) tetrahydrofuran | 22 parts by weight |
| (f) dimethylformamide | 56 parts by weight |
| (g) methyl isobutyl ketone | 22 parts by weight |

Next, on this was provided a silicone rubber layer of thickness 2 g/m$^2$ by applying an addition-type silicone rubber layer composition with the following composition using a bar coater and hardening for 2 minutes at 125° C.

| Silicone Rubber Layer Composition (solids component concentration 11 wt %) | |
|---|---|
| (a) polysiloxane containing vinyl groups (terminal hydroxy groups) | 90 parts by weight |
| (b) hydrogen polysiloxane | 8 parts by weight |

-continued

| | |
|---|---|
| (c) polymerization inhibitor | 2 parts by weight |
| (d) catalyst | 5 parts by weight |
| <Solvent Component> | |
| (e) "Isopar-E" (produced by Exxon Chemical Japan Ltd.) | |

Using a calender roller, "Torayfan" polypropylene film (produced by Toray Industries, Inc.) of thickness 8 $\mu$m was laminated to the laminate obtained as described above, to obtain a directly imageable waterless lithographic printing plate precursor. The developing and evaluation were carried out in the same way as in Example 1.

Comparative Example 5, Example 4

Preparation of the plate and evaluation were carried out in the same way as in Example 3 except that, in the heat sensitive layer composition (b), was changed from Compound D which had N—N bonds in side chains to Compound E which did not contain N—N bonds (Comparative Example 5), or to Compound F (Example 4) which had N—N bonds in the side chains.

Compound E

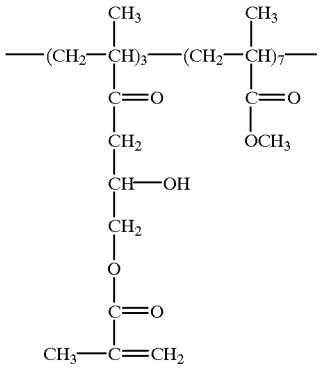

(MW = 50,000)

Compound F

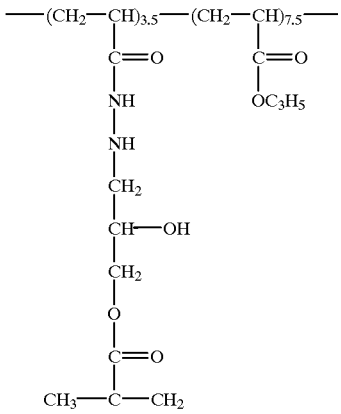

(MW = 22,000)

Example 5 preparation of the plate material and evaluation were all carried out in the same way as in Example 3 except that the heat sensitive layer composition was changed to the following.

| Heat Sensitive Layer Composition (solids component concentration 10 wt %) | |
|---|---|
| (a) infrared absorbing colouring matter ("Kayasorb" IR-820(B), produced by Nippon Kayaku Co., Ltd.) | 10 parts by weight |
| (b) Compound D with N—N bonds in side chains | 85 parts by weight |
| (c) polyglycerol polyglycidyl ether ("Denacol" EX512, produced by Nagase Chemicals Ltd.) | 5 parts by weight |
| <Solvent Component> | |
| (d) tetrahydrofuran | 22 parts by weight |
| (e) dimethylformamide | 56 parts by weight |
| (f) methyl isobutyl ketone | 22 parts by weight |

Example 6

Preparation of the plate and evaluation were carried out in the same way as in Example 5 except that the Compound D with N—N bonds in side chains which comprised (b) in the heat sensitive composition of Example 5 was changed to Compound F with N—N bonds in side chains.

Example 7

Preparation of the plate material and evaluation were all carried out in the same way as in Example 5 except that the heat sensitive layer composition was changed to the following.

| Heat Sensitive Layer Composition (solids component concentration 10 wt %) | |
|---|---|
| (a) infrared absorbing colouring matter ("Kayasorb" IR-820(B), produced by Nippon Kayaku Co., Ltd.) | 10 parts by weight |
| (b) Compound F with N—N bonds in side chains | 35 parts by weight |
| (c) polyglycerol polyglycidyl ether ("Denacol" EX512, produced by Nagase Chemicals Ltd.) | 5 parts by weight |
| (d) polyurethane resin composition ("Sanprene" IB-465, solids component 30 wt %, produced by Sanyo Chemical Industries, Ltd.) (having a dimethyl formamide component of 119 parts by weight) | 170 parts by weight |
| <Solvent Component> | |
| (d) tetrahydrofuran | 22 parts by weight |
| (e) dimethylformamide | 56 parts by weight |
| (f) methyl isobutyl ketone | 22 parts by weight |

Example 8

Preparation of the plate material and evaluation were all carried out in the same way as in Example 5 except that the heat sensitive layer composition was changed to the following.

| Heat Sensitive Layer Composition (solids component concentration 10 wt %) | |
|---|---|
| (a) infrared absorbing dyestuff ("Kayasorb" IR-820(B), produced by Nippon Kayaku Co., Ltd.) | 10 parts by weight |
| (b) Compound G with N—N bonds in side chains | 40 parts by weight |

-continued

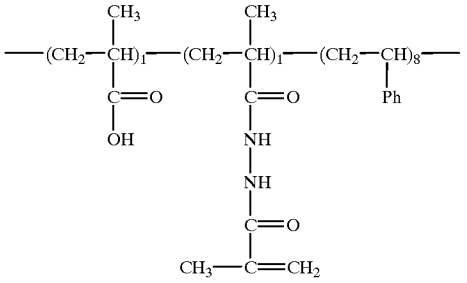

Compound G (MW = 40,000)

| | | |
|---|---|---|
| (c) | polyglycerol polyglycidyl ether ("Denacol" EX512, produced by Nagase Chemicals Ltd.) | 5 parts by weight |
| (d) | polyurethane resin composition ("Sanprene" IB-465, solids component 30 wt %, produced by Sanyo Chemical Industries, Ltd.) (having a dimethyl formamide component of | 150 parts by weight) |
| | <Solvent Component> | |
| (e) | tetrahydrofuran | 22 parts by weight |
| (f) | dimethylformamide | 56 parts by weight |
| (g) | methyl isobutyl ketone | 22 parts by weight |

Example 9

A heat insulating layer of film thickness 4 g/m$^2$ was provided by coating a primer liquid comprising the following composition onto a degreased aluminium sheet of thickness 0.15 mm using a bar coater and drying for 2 minutes at 180° C.

| Heat Insulating Layer Composition (solids component concentration 13 wt %) | |
|---|---|
| (a) polyurethane resin ("Sanprene" LQ-T1331, produced by Sanyo Chemical Industries Ltd.) | 90 parts by weight |
| (b) blocked isocyanate ("Takenate" B830, produced by Takeda Chemical Industries Ltd.) | 35 parts by weight |
| (c) epoxy-phenol-urea resin (SJ9372, produced by Kansai Paint Co. Ltd.) | 8 parts by weight |
| (d) titanium oxide | 10 parts by weight |
| <Solvent Component> | |
| (d) dimethylformamide | |

Next, on this, there was provided a heat sensitive layer of film thickness 1 g/m$^2$ by coating the following heat sensitive layer composition using a bar coater and drying for 3 minutes at 90° C.

| Heat Sensitive Layer Composition (solids component concentration 10 wt %) | |
|---|---|
| (a) infrared absorbing colouring matter ("Kayasorb" IR-820(B), produced by Nippon Kayaku Co., Ltd.) | 10 parts by weight |
| (b) Compound D with N—N bonds in side chains | 85 parts by weight |
| (c) polyglycerol polyglycidyl ether ("Denacol" EX512, produced by Nagase Chemicals Ltd.) | 5 parts by weight |

-continued

| | |
|---|---|
| <Solvent Component> | |
| (d) tetrahydrofuran | 22 parts by weight |
| (e) dimethylformamide | 56 parts by weight |
| (f) methyl isobutyl ketone | 22 parts by weight |

On this, an addition-type silicone rubber layer of composition as in Example 3 was provided under the same conditions and then, using a calender roller, "Torayfan" polypropylene film (produced by Toray Industries, Inc.) of thickness 8 $\mu$m was laminated onto it, to obtain a directly imageable waterless lithographic printing plate precursor. The developing and evaluation were carried out in the same way as in Example 1.

Example 10

Preparation of the plate and evaluation were carried out in the same way as in Example 9 except that the Compound D with N—N bonds in side chains which comprised (b) in the heat sensitive composition of Example 9 was changed to Compound F with N—N bonds in side chains.

Example 11

Preparation of the plate material and the evaluation were all carried out in the same way as in Example 9 except that the heat sensitive layer composition was changed to the following.

| Heat Sensitive Layer Composition (solids component concentration 10 wt %) | |
|---|---|
| (a) infrared absorbing colouring matter ("Kayasorb" IR-820(B), produced by Nippon Kayaku Co., Ltd.) | 10 parts by weight |
| (b) Compound F with N—N bonds | 60 parts by weight |
| (c) polyglycerol polyglycidyl ether ("Denacol" EX512, produced by Nagase Chemicals Ltd.) | 5 parts by weight |
| (d) Polyurethane resin composition ("Sanprene" IB-465, solids component 30 wt %, produced by Sanyo Chemical Industries, Ltd.) (having a dimethyl formamide component of 58 parts by weight) | 83 parts by weight |
| <Solvent Component> | |
| (e) tetrahydrofuran | 22 parts by weight |
| (f) dimethylformamide | 56 parts by weight |
| (g) methyl isobutyl ketone | 22 parts by weight |

Example 12

Preparation of the plate material and evaluation were all carried out in the same way as in Example 11 except that, in the heat sensitive layer, (b) was changed from a content of 60 parts by weight of the Compound F containing N—N bonds in side chains to 35 parts by weight, and (d) was changed from a polyurethane resin composition content of 83 parts by weight (of which 25 parts by weight was solids component and 58 parts by weight was solvent component) to 170 parts by weight (of which 51 parts by weight was solids component and 119 parts by weight was solvent component).

Example 13

Preparation of the plate material and evaluation were all carried out in the same way as in Example 11 except that, in the heat sensitive layer, (b) was changed from a content of 60 parts by weight of the Compound F containing N—N bonds in side chains to 15 parts by weight, and (d) was changed from a polyurethane resin composition content of 83 parts by weight (of which 25 parts by weight was solids component and 58 parts by weight was solvent component) to 233 parts by weight (of which 70 parts by weight was solids component and 163 parts by weight was solvent component).

Example 14

Preparation of the plate material and evaluation were all carried out in the same way as in Example 9 except that the heat sensitive layer composition was changed to the following.

| Heat Sensitive Layer Composition (solids component concentration 10 wt %) | |
|---|---|
| (a) infrared absorbing colouring matter ("Kayasorb" IR-820(B), produced by Nippon Kayaku Co., Ltd.) | 10 parts by weight |
| (b) Compound G with N—N bonds in side chains | 40 parts by weight |
| (c) polyglycerol polyglycidyl ether ("Denacol" EX512, produced by Nagase Chemicals Ltd.) | 5 parts by weight |
| (d) polyurethane resin composition ("Sanprene" IB-465, solids component 30 wt %, produced by Sanyo Chemical Industries, Ltd.) (having a dimethyl formamide component of 105 parts by weight) | 150 parts by weight |
| <Solvent Component> | |
| (e) tetrahydrofuran | 22 parts by weight |
| (f) dimethylformamide | 56 parts by weight |
| (g) methyl isobutyl ketone | 22 parts by weight |

Synthesis Example 1

Method of synthesizing acrylic acid/butyl acrylate copolymer (3/7)

21.6 g (0.3 mol) of acrylic acid, 89.6 g (0.7 mol) of butyl acrylate, 3.28 g of 2,2'-azobisisobutyronitrile (AIBN) and 1200 ml of THF were introduced into a reactor and the atmosphere inside the container replaced with nitrogen. While stirring, heating was carried out for 8 hours at 60° C. and after the polymerization reaction had proceeded, the reaction mixture was added dropwise to 3000 ml of methanol and the polymer precipitated. Acrylic acid/butyl acrylate copolymer was obtained. When the $T_g$ of this compound was measured by the DSC (Differential Scanning Calorimetry) method using a SSC5200/RDC220 (made by Seiko Denshi K.K.), it was found to be −23.5° C.

Synthesis Example 2

Method of synthesizing polyacrylic acid hydrazide 370.7 g (1 mol equivalent of carboxyl groups) of the aforesaid acrylic acid/butyl acrylate copolymer (3/7), 50.1 g (1 mol) of hydrazine hydrate and MIBK were introduced into a 1000 ml reaction vessel, and then the atmosphere inside the container replaced by nitrogen. While stirring, heating was carried out for 4 hours at 80° C., after which the reaction product was separated and polyacrylic acid hydrazide obtained.

Example 15

A heat insulating layer of film thickness 4 g/m$^2$ was applied by coating a primer liquid of composition identical to that in Example 1 onto a degreased aluminium sheet of thickness 0.15 mm using a bar coater and drying for 2 minutes at 200° C. Next, on this, there was provided a heat sensitive layer of film thickness 1 g/m$^2$ by applying the following heat sensitive layer composition using a bar coater and the drying for 3 minutes at 90° C.

| Heat Sensitive Layer Composition (solids component concentration 11 wt %) | |
|---|---|
| (a) carbon black dispersed acrylic resin (of which carbon black 15 parts by weight) | 30 parts by weight |
| (b) semicarbazide sulphate | 36 parts by weight |
| (c) polyglycerol polyglycidyl ether ("Denacol" EX512, produced by Nagase Chemicals Ltd.) | 24 parts by weight |
| (d) acrylic acid/butyl acrylate copolymer (3/7) synthesized in Synthesis Example 1 | 10 parts by weight |
| <Solvent Component> | |
| (h) tetrahydrofuran | 60 parts by weight |
| (i) dimethylformamide | 20 parts by weight |
| (j) methyl isobutyl ketone | 20 parts by weight |

Next, on this, there was provided a silicone rubber layer of film thickness 2 g/m$^2$ by the coating of an addition type silicon rubber layer composition of identical composition to that in Example 3, using a bar coater, and drying for 3 minutes at 125° C.

On the laminate obtained as described above, there was laminated 8 $\mu$m thickness "Torayfan" polypropylene film (produced by Toray Industries, Inc.) using a calender roller, and there was obtained a directly imageable waterless planographic printing plate precursor. The developing and evaluation were carried out in the same way as in Example 1.

Example 16

Preparation of the plate and evaluation were all carried out in the same way as in Example 15 except that, in the heat sensitive layer, (b) was changed from a semicarbazide sulphate content of 36 parts by weight to 15 parts by weight, (c) was changed from a Denacol EX512 content of 24 parts by weight to 10 parts by weight, and (d) was changed from an acrylic acid/butyl acrylate copolymer (3/7) content of 10 parts by weight to 45 parts by weight.

Example 17

Preparation of the plate and evaluation were all carried out in the same way as in Example 15 except that, in the heat sensitive layer, (b) was changed from a semicarbazide sulphate content of 36 parts by weight to 6 parts by weight, (c) was changed from a Denacol EX512 content of 24 parts by weight to 4 parts by weight, and (d) was changed from an acrylic acid/butyl acrylate copolymer (3/7) content of 10 parts by weight to 60 parts by weight.

Comparative Example 6

Preparation of the plate and evaluation were all carried out in the same way as in Example 15 except that, in the heat sensitive layer, (b) was changed from a semi-carbazide sulphate content of 36 parts by weight to 0 parts by weight, (c) was changed from a Denacol EX512 content of 24 parts by weight to 0 parts by weight, and (d) was changed from an acrylic acid/butyl acrylate copolymer (3/7) content of 10 parts by weight to 70 parts by weight.

Example 18

Preparation of the plate and evaluation were all carried out in the same way as in Example 15 except that, in the heat sensitive layer, (b) was changed from semicarbazide sulphate to acetohydrazide.

Example 19

Preparation of the plate and evaluation were all carried out in the same way as in Example 18 except that, in the heat sensitive layer, (b) was changed from an aceto-hydrazide content of 36 parts by weight to 15 parts by weight, (c) was changed from a Denacol EX512 content of 24 parts by weight to 10 parts by weight, and (d) was changed from an acrylic acid/butyl acrylate copolymer (3/7) content of 10 parts by weight to 45 parts by weight.

Example 20

Preparation of the plate and evaluation were all carried out in the same way as in Example 18 except that, in the heat sensitive layer, (b) was changed from an acetohydrazide content of 36 parts by weight to 6 parts by weight, (c) was changed from a Denacol EX512 content of 24 parts by weight to 4 parts by weight, and (d) was changed from an acrylic acid/butyl acrylate copolymer (3/7) content of 10 parts by weight to 60 parts by weight.

Example 21

Preparation of the plate material and evaluation were all carried out in the same way as in Example 15 except that the heat sensitive layer composition was changed to the following.

| Heat Sensitive Layer Composition (solids component concentration 11 wt %) | |
|---|---|
| (a) carbon black dispersed acrylic resin (of which carbon black 15 parts by weight) | 30 parts by weight |
| (b) polyacrylic acid hydrazide synthesized in Synthesis Example 2 | 36 parts by weight |
| (c) polyglycerol polyglycidyl ether ("Denacol" EX512, produced by Nagase Chemicals Ltd.) | 12 parts by weight |
| (d) acrylic acid/butyl acrylate copolymer (3/7) synthesized in Synthesis Example 1 | 22 parts by weight |
| <Solvent Component> | |
| (h) tetrahydrofuran | 60 parts by weight |
| (i) dimethylformamide | 20 parts by weight |
| (j) methyl isobutyl ketone | 20 parts by weight |

Example 22

Preparation of the plate and evaluation were all carried out in the same way as in Example 21 except that, in the heat sensitive layer, (b) was changed from a polyacrylic acid hydrazide content of 36 parts by weight to 15 parts by weight, (c) was changed from a Denacol EX512 content of 12 parts by weight to 5 parts by weight, and (d) was changed from an acrylic acid/butyl acrylate copolymer (3/7) content of 22 parts by weight to 50 parts by weight.

Example 23

Preparation of the plate and evaluation were all carried out in the same way as in Example 21 except that, in the heat sensitive layer, (b) was changed from a polyacrylic acid hydrazide content of 36 parts by weight to 6 parts by weight, (c) was changed from a Denacol EX512 content of 12 parts by weight to 2 parts by weight, and (d) was changed from an acrylic acid/butyl acrylate copolymer (3/7) content of 22 parts by weight to 62 parts by weight.

Synthesis Example 3

Method of synthesizing poly-methacrylic acid hydrazide 10 g (0.2 mol) of hydrazine hydrate and 40 g of DMF were introduced into a 1000 ml reaction vessel and the atmosphere inside the vessel replaced with nitrogen. While stirring, there was slowly added dropwise, using a dropping funnel, 500 g of a DMF solution of 100 g (1 mol equivalent of ester groups) of polymethyl methacrylate. After heating for 4 hours at 80° C. the reaction solution was poured into a large volume of methanol and the product precipitated.

Example 24

Preparation of the plate material and evaluation were all carried out in the same way as in Example 15 except that the heat sensitive layer composition was changed to the following.

| Heat Sensitive Layer Composition (solids component concentration 11 wt %) | |
|---|---|
| (a) infrared absorbing colouring matter ("Kayasorb" IR-820(B), produced by the Nippon Kayaku Co., Ltd.) | 10 parts by weight |
| (b) polymethacrylic acid hydrazide synthesized in Synthesis Example 3 | 60 parts by weight |
| (c) polyglycerol polyglycidyl ether ("Denacol" EX512, produced by Nagase Chemicals Ltd.) | 10 parts by weight |
| (d) polyurethane resin ("Sanprene" LQ-T1331D, 20 wt % solids component, produced by Sanyo Chemical Industries Ltd.) (having a dimethyl formamide component of 80 parts by weight) | 100 parts by weight |
| <Solvent Component> | |
| (h) tetrahydrofuran | 30 parts by weight |
| (i) dimethylformamide | 50 parts by weight |
| (j) methyl isobutyl ketone | 20 parts by weight |

Example 25

A heat insulating layer of film thickness 4 g/m$^2$ was applied by coating a primer liquid of the same composition as in Example 1 onto a degreased aluminium sheet of thickness 0.15 mm using a bar coater and drying for 2 minutes at 200° C. Next, a heat sensitive layer of film thickness 1 g/m$^2$ was provided on top of this by application of the following heat sensitive layer composition using a bar coater and drying for 3 minutes at 90° C.

| Heat Sensitive Layer Composition (solids component concentration 11 wt %) | |
|---|---|
| (a) infrared absorbing colouring matter ("Kayasorb" IR-820(B), produced by the Nippon Kayaku Co., Ltd.) | 10 parts by weight |
| (b) semicarbazide sulphate | 20 parts by weight |
| (c) polyglycerol polyglycidyl ether ("Denacol" EX512, produced by Nagase Chemicals Ltd.) | 15 parts by weight |
| (d) ester of methacrylic acid and pentaerythritol | 30 parts by weight |
| (e) epoxy methacrylate ("Denacol" DM622, produced by Nagase Chemicals Ltd.) | 15 parts by weight |
| (f) AIBN | 4 parts by weight |
| (g) benzophenone | 5 parts by weight |
| (h) 4,4'-bis(dimethylamino)benzophenone | 1 part by weight |
| <Solvent Component> | |
| (i) tetrahydrofuran | 60 parts by weight |

-continued

| | |
|---|---|
| (j) dimethylformamide | 20 parts by weight |
| (k) methyl isobutyl ketone | 20 parts by weight |

After irradiating the entire plate face with ultraviolet light of 1000 mJ/cm$^2$ using a 2.8 kW ultrahigh pressure mercury lamp, there was applied thereon, using a bar coater, a deoxime condensation type silicone rubber layer composition of the same composition as in Example 1, and drying carried out for 3 minutes at 125° C. to provide a silicone rubber layer of film thickness 2 g/m$^2$.

On the laminate obtained as described above, there was laminated 8 $\mu$m thickness "Torayfan" polypropylene film (produced by Toray Industries, Inc.) using a calender roller, and there was obtained a directly imageable waterless planographic printing plate precursor. Evaluation was carried out in the same way as in Example 1.

As shown in Tables 1–3, the plate materials containing N—N bonds in the heat sensitive layer had high sensitivity and plates were obtained in which the state of the edge at the boundary between the image and non-image areas was good. Furthermore, by suitable selection of the light-to-heat converting material and the compound with N—N bonds, plate materials were obtained where heat sensitive layer in the laser irradiated region remained even after developing.

Example 26

After roughening the surface of a degreased a luminium sheet of thickness 0.24 mm with a sand slurry and a nylon brush, the sheet was dipped for 60 seconds in a 10% aqueous solution of sodium hydroxide and then washed with pure water. This aluminium sheet was anodized in 15% sulphuric acid at a current density of 240 coulombs/dm$^2$.

On the surface of the substrate which had been surface treated in this way, there was provided a heat sensitive layer of film thickness 1.5 g/m$^2$ by applying a heat sensitive liquid of the following composition using a bar coater and drying for 5 minutes at 100° C.

| Heat Sensitive Layer Composition (solids component concentration 15 wt %) | |
|---|---|
| (a) infrared absorbing colouring matter ("Kayasorb" IR-820(B), produced by the Nippon Kayaku Co., Ltd.) | 10 parts by weight |
| (b) Compound D with N—N bonds in side chains | 65 parts by weight |
| (c) Polyglycerol polyglycidyl ether ("Denacol" EX512, | |
| (d) Poly(hydroxyethylmethacrylate/methyl methacrylate) | 20 parts by weight |
| <Solvent Component> | |
| (d) tetrahydrofuran | 22 parts by weight |
| (e) dimethylformamide | 56 parts by weight |
| (f) methyl isobutyl ketone | 22 parts by weight |

The directly imageable planographic printing plate precursor suitable for printing in the presence of dampening water obtained in this way was subjected to processing in the same way as in Example 1. As the developer, there was used sodium hydroxide solution of pH=10, with this being impregnated into a gauze and then well rubbed over the entire face of the plate. After developing in this way, the planographic printing plate was washed with water. Prior to deploying ink, wetting water was applied, and when the sensitivity was measured in the same way as in Example 1, it was found that the ink was repelled in the laser irradiated regions where the laser output was 200 mW or more, while ink was accepted by the laser unirradiated regions and the regions where the laser irradiation output had been 150 mW or less. Thus, the heat sensitive layer of the present invention can also be applied to directly imageable planographic printing plates using wetting water.

It can be seen from the above that by including a hydrazine compound in the heat sensitive layer in accordance with the present invention, a directly imageable waterless planographic printing plate of high sensitivity was obtained.

TABLE 1

| | Examples | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Main constituents of heat sensitive layer | | | | | | | | | | | | | | | | | |
| Light to heat converting material | | | | | | | | | | | | | | | | | |
| Type | Carbon black | | | | | | | | Polymethine dye | | | | | | Carbon black | | |
| Parts by weight | 15 | | | | | | | | 10 | | | | | | 15 | | |
| Thermally decomposing material | | | | | | | | | | | | | | | | | |
| Hydrazine compound | A | C | D | F | D | | F | G | D | | F | | | G | Semicarbazide sulphate | | |
| Other | | | | | | | | | — | | | | | | | | |
| Parts by weight | | 50 | | | 85 | | 35 | 40 | 85 | 60 | 35 | 15 | | 40 | 36 | 15 | 6 |
| Resin | | | | | | | | | | | | | | | | | |
| Type | Epoxy/Acryl | | | | Epoxy | | Epoxy/Polyurethane | | Epoxy | Epoxy/Polyurethane | | | | | Epoxy/Acryl/Synth. example 1 | | |
| Parts by weight | 5/15 | | 10/15 | | 5 | | 5/51 | 5/45 | 5 | 5/25 | 5/51 | 5/70 | | 5/45 | 24/15/10 | 10/15/45 | 4/15/60 |
| Type of silicone rubber layer | De-oxime type | | | | | | | | Addition type | | | | | | | | |

TABLE 1-continued

| | Examples | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Plate sensitibity/ State of image area - non image area boundary | | | | | | | | | | | | | | | | | |
| Laser output (mW) | | | | | | | | | | | | | | | | | |
| 350 | | ○/○ | | | ○/○ | | ○/ ○ | | | ○/ ○ | | | | ○/○ | | | ○/○ |
| 300 | | | | | | | | | | | | | | | | | |
| 250 | | | | | | | | | | | | | | | | | |
| 200 | | | | | | | | | | | | | | | | | Δ/— |
| 150 | | | | | | | | | | | | | | | | | X/— |
| 100 | | Δ/— | | | | | Δ/— | | | | | | | Δ/— | | | |
| Remaining heat sensitive layer in 350 mV irradiation region (%) | 45 | 25 | 50 | 55 | 75 | 85 | 90 | 70 | | 80 | 85 | | 75 | 70 | 25 | 30 | |

TABLE 2

| | Examples | | | | | | | | |
|---|---|---|---|---|---|---|---|---|---|
| | 18 | 19 | 20 | 21 | 22 | 23 | 24 | 25 | 26 |
| Main constituents of heat sensitive layer | | | | | | | | | |
| Light to heat converting material | | | | | | | | | |
| Type | Carbon black | | | | | | Polymethine dye | | |
| Parts by weight | 15 | | | | | | 10 | | |
| Thermally decomposing material | | | | | | | | | |
| Hydrazine compound | Acetohydrazide | | | | Synthesis example 2 | | Synth. ex. 3 | Semi-carbazide sulphate | D |
| Other | | | | | — | | | | |
| Parts by weight | 36 | 15 | 6 | 36 | 15 | 6 | 60 | 20 | 65 |
| Resin | | | | | | | | | |
| Type | Epoxy/Acryl/Synth. ex. 1 | | | | | | Epoxy/ Poly-urethane | Epoxy/Other | |
| Parts by weight | 24/15/10 | 10/15/45 | 4/15/60 | 12/15/22 | 5/15/50 | 2/15/62 | 10/20 | 15/45 | 5/20 |
| Type of silicone rubber layer | Addition type | | | | | | | De-oxime type | None |
| Plate sensitibity/ State of image area - non image area boundary | | | | | | | | | |
| Laser output (mW) | | | | | | | | | |
| 350 | ○/○ | | ○/○ | ○/○ | ○/○ | ○/○ | ○/○ | ○/○ | |
| 300 | | | | | | | | | |
| 250 | | | | | | Δ/— | | | |
| 200 | | | X/— | | | X/— | | | |
| 150 | | | | | Δ/— | | | X/— | |
| 100 | Δ/— | | | Δ/— | X/— | | Δ/— | | |
| Remaining heat sensitive layer in 350 mV irradiation region (%) | 25 | 30 | | 35 | 45 | 50 | 75 | 50 | — |

TABLE 3

| | Comparative examples | | | | | |
|---|---|---|---|---|---|---|
| | 1 | 2 | 3 | 4 | 5 | 6 |
| Main constituents of heat sensitive layer | | | | | | |
| Light to heat converting material | | | | | | |
| Type | | | Carbon black | | | |
| Parts by weight | | | 15 | | | |
| Thermally decomposing material | | | | | | |
| Hydrazine compound | | — | | | — | |
| Other | — | Nitrocellulose | | | | |
| Parts by weight | | 36 | 56 | 16 | | |
| Resin | | | | | | |
| Type | Epoxy/Acryl/ Compound B | Epoxy/Melamine | | | Epoxy/Acryl/ Compound E | Acryl/ Synth. ex. 1 |
| Parts by weight | 5/15/50 | 25/24 | 15/14 | 35/34 | 10/15/50 | 15/70 |
| Type of silicone rubber layer | | De-oxime type | | | Addition type | |
| Plate sensitibity/ State of image area - non image area boundary | | | | | | |
| Laser output (mW) | | | | | | |
| 350 | X/— | ○/Δ | ○/Δ | Δ/— | X/— | |
| 300 | | Δ/— | | X/— | | |
| 250 | | | X/— | | | |
| 200 | | | | | | |
| 150 | | | | | | |
| 100 | | | | | | |
| Remaining heat sensitive layer in 350 mV irradiation region (%) | Unexposed heat sensitive layer | 20 | 10 | 25 | Unexposed heat sensitive layer | |

What is claimed is:

1. A directly imageable waterless planographic heat mode type printing plate precursor comprising, in order, a heat sensitive layer on a substrate and a silicone rubber layer on the heat sensitive layer, wherein the heat sensitive layer comprises (A) a light-to-heat converting material and (B) a hydrazine compound, wherein said hydrazine compound further comprises a moiety selected from the group consisting of a hydroxyl group, an acid group and an acrylic group, said acid group being obtained by the reaction of hydrazine and a copolymer of (meth)acrylic acid and (meth)acrylate ester.

2. The printing plate precursor according to claim 1, wherein the heat sensitive layer further comprises a crosslinking agent.

3. The printing plate precursor according to claim 2, wherein the crosslinking agent is an epoxy compound.

4. The printing plate precursor according to claim 1, wherein the heat sensitive layer further comprises a polymer with carboxyl groups.

5. The printing plate precursor according to claim 4, wherein the polymer with carboxyl groups is a copolymer of (meth)acrylic acid and (meth)acrylate ester.

6. The printing plate precursor according to claim 1, wherein the heat sensitive layer further comprises a monomer with a carboxyl group and an ethylenic double bond.

7. The printing plate precursor according to claim 1, wherein the heat sensitive layer further comprises a binder other than a copolymer of (meth)acrylic acid and (meth) acrylate ester, and a glass transition temperature $T_g$ of the binder is less than 0° C.

8. The printing plate precursor according to claim 1, wherein the heat sensitive layer is hardened by means of a crosslinking agent.

9. A directly imageable waterless planographic heat mode type printing plate precursor comprising a heat sensitive layer on a substrate and a silicone rubber layer on the heat sensitive layer, wherein the heat sensitive layer comprises (A) a light-to-heat converting material and (B) a hydrazine compound, wherein the hydrazine compound (B) contains an N—N bond containing hydroxyl groups.

10. A directly imageable waterless planographic heat mode type printing plate precursor comprising a heat sensitive layer on a substrate and a silicone rubber layer on the heat sensitive layer, wherein the heat sensitive layer comprises (A) a light-to-heat converting material and (B) a hydrazine compound, wherein the hydrazine compound (B) contains an N—N bond and is an acid hydrazine obtained by the reaction of hydrazine and a copolymer of (meth)acrylic acid and (meth)acrylate ester.

11. A directly imageable waterless planographic heat mode type printing plate precursor comprising a heat sensitive layer on a substrate and a silicone rubber layer on the heat sensitive layer, wherein the heat sensitive layer comprises (A) a light-to-heat converting material and (B) a hydrazine compound, wherein the hydrazine compound (B) contains an N—N bond and is an acrylic resin with N—N bonds in the molecule.

* * * * *